US009346147B2

(12) United States Patent
Chalmers et al.

(10) Patent No.: US 9,346,147 B2
(45) Date of Patent: May 24, 2016

(54) PEDESTAL STYLE WATERJET ORIFICE ASSEMBLY

(71) Applicant: Hypertherm, Inc., Hanover, NH (US)

(72) Inventors: Eric Chalmers, Minneapolis, MN (US); Jon Lindsay, Hanover, NH (US); Cedar Vandergon, New Brighton, MN (US)

(73) Assignee: HYPERTHERM, INC., Hanover, NH (US)

( * ) Notice: Subject to any disclaimer, the term of this patent is extended or adjusted under 35 U.S.C. 154(b) by 87 days.

(21) Appl. No.: 14/272,180

(22) Filed: May 7, 2014

(65) Prior Publication Data

US 2015/0321315 A1 Nov. 12, 2015

(51) Int. Cl.

| | |
|---|---|
| ***B24C 5/04*** | (2006.01) |
| ***B24C 1/04*** | (2006.01) |
| ***B24C 7/00*** | (2006.01) |
| ***B26F 3/00*** | (2006.01) |

(52) U.S. Cl.

CPC . *B24C 5/04* (2013.01); *B24C 1/045* (2013.01); *B24C 7/0007* (2013.01); *B26F 3/004* (2013.01); *Y10T 29/49348* (2015.01)

(58) Field of Classification Search

CPC ..... B24C 5/04; B24C 1/04; B26F 3/00
USPC ..... 451/102, 75, 90
See application file for complete search history.

(56) References Cited

U.S. PATENT DOCUMENTS

| | | | | |
|---|---|---|---|---|
| 5,199,640 | A * | 4/1993 | Ursic | B05B 15/065 239/11 |
| 6,715,701 | B1 * | 4/2004 | Julien | B05B 1/10 239/429 |
| 2005/0252352 | A1 * | 11/2005 | Tateiwa | B24C 1/045 83/177 |

OTHER PUBLICATIONS

International Search Report and Written Opinion in corresponding application PCT/US2015/029346, Jul. 29, 2015, 12 pages.

* cited by examiner

*Primary Examiner* — Robert Rose
(74) *Attorney, Agent, or Firm* — Proskauer Rose LLP

(57) ABSTRACT

An orifice assembly for a liquid jet cutting system includes a generally cylindrical base, an orifice member, and an orifice cap. The base includes a conduit that extends through a central axis from a top surface to a bottom surface of the base. The base also includes a pedestal that defines a protrusion from the top surface, the pedestal having a planar top region substantially parallel to the planar bottom region of the base. The orifice member sits on the planar top region of the pedestal. The orifice member defines an intermediate conduit therethrough, the intermediate conduit in fluid communication with the base conduit. The orifice cap defines an upper conduit therethrough, the upper conduit in fluid communication with the intermediate conduit of the orifice member. The orifice cap is configured to secure the orifice member to the pedestal.

48 Claims, 5 Drawing Sheets

PEDESTAL STYLE WATERJET ORIFICE ASSEMBLY

FIELD OF THE INVENTION

The invention relates generally to the field of waterjet cutting systems and processes. More specifically, the invention relates to methods and apparatuses for aligning a water stream within a waterjet cutting head.

BACKGROUND

Waterjet cutting systems produce high pressure, high-velocity jets of water for cutting materials. These systems typically function by pressurizing water or another suitable fluid to a high pressure (e.g., up to 90,000 pounds per square inch or greater) and forcing the fluid through a small orifice at high velocity to concentrate a large amount of energy on a small area. To cut hard materials, a water jet can be "abrasive" or include abrasive particles within the water jet for increasing cutting ability. As used herein, the term "waterjet" includes any substantially pure water jet, liquid jet, and/or slurry jet. As used herein, the term "pump" means "ultra-high pressure pump" between about 30,000-90,000 pounds per square inch (PSI) or above. However, one of ordinary skill in the art could easily appreciate that the invention also applies to low pressure systems.

During operation of waterjet cutting systems, fluid (e.g., water) is directed to a waterjet orifice assembly for constriction and alignment by the waterjet orifice assembly. The water stream exiting the orifice assembly must be well-aligned to an axis of the waterjet nozzle such that the water stream does not significantly touch the interior wall of the nozzle prior to exiting the cutting head. It is preferable for the water stream to be centered within the nozzle. Poor water stream alignment will cause the nozzle life and cut performance (e.g. cut speed, part tolerance and edge quality) to deteriorate. Currently, orifice assemblies are built by placing an orifice in a cavity of a machined base or housing and then pressing a retaining ring over the orifice to secure the orifice in place. However, using this approach it can be difficult to machine the cavity to the high level of accuracy that is required for excellent alignment of the orifice stream to the axis of the nozzle. Orifice assemblies can also be manufactured by assembling the orifice into a base blank; aligning the water stream exiting the blank; and machining the orifice assembly datum features accordingly to achieve proper alignment. However, this process can be very costly, and it can have difficulty achieving high water stream alignment. What is needed is a well-aligned orifice assembly that can be produced consistently without a costly alignment procedure.

SUMMARY OF THE INVENTION

The present invention addresses the unmet need for a waterjet cutting system that achieves high water stream alignment without the need for a costly alignment procedure. In some embodiments, substantial parallelism is introduced between the bottom surface of the base component and the top surface of the orifice in an orifice assembly. In some embodiments, substantial perpendicularity is introduced between the bottom surface of the base component and a longitudinal axis of the base component. In some embodiments, a pedestal-shaped base component protrudes from the top surface of the base component and allows the orifice seating surface to be accessed by equipment capable of grinding the orifice seating surface to be substantially parallel to the bottom surface of the base component.

In some embodiments, the pedestal includes a top surface that protrudes above the rest of the orifice base. A press cap is press fit to the pedestal and shaped to secure the orifice component to the pedestal. In some embodiments, a press cap can be designed with an inner diameter surface which is press fit onto the outer diameter of the pedestal. In some embodiments, the press cap can be designed such that an outer diameter of the press cap contacts an inner surface of a depression in the top surface of the base component. In addition to providing a high degree of parallelism between the orifice seating surface and the bottom surface of the base component, the invention provides improved waterjet cutting performance (e.g. improved cutting speed, part tolerance, and/or edge quality) and consistent production of well-aligned orifice assemblies, without the need for costly alignment procedures.

In one aspect, the invention features an orifice assembly for a liquid jet cutting system. The orifice assembly includes a base having a bottom surface and a top surface. The base defines a base conduit generally parallel to a central axis of the orifice assembly. The top surface includes a planar top region defined by at least a portion of an exterior surface of the base. The planar top region is at least substantially perpendicular to the base conduit. The orifice assembly includes an orifice structure disposed on the planar top region of the top surface of the base. The orifice structure defines an intermediate conduit therethrough. The intermediate conduit is aligned with and in fluid communication with the base conduit. The intermediate conduit is at least substantially perpendicular to the planar top region and parallel to the central axis of the orifice assembly.

In some embodiments, the base is configured to matingly engage an abrasive body. In some embodiments, the base is a cutting head or an abrasive body. In some embodiments, the base conduit comprises a first cylindrical portion and a second cylindrical portion. The first cylindrical portion can have a different diameter than the second cylindrical portion. In some embodiments, a diameter of the base conduit is larger than a diameter of the intermediate conduit. In some embodiments, the top surface comprises a sealing surface. In some embodiments, a pedestal is located within a depression of the top surface. In some embodiments, the base conduit comprises a pedestal section and a base section. The pedestal section can have a smaller diameter than the base section.

In another aspect, the invention features an orifice assembly for a liquid jet cutting system. The orifice assembly includes a generally cylindrical base having a planar bottom region, a central axis and a top surface. The base defines a base conduit generally parallel to the central axis and extending from the top surface to the planar bottom region of the base. The base includes a pedestal defining a protrusion from the top surface of the base. The pedestal has a planar top region substantially parallel to the planar bottom region of the base. The orifice assembly includes an orifice member on the planar top region of the pedestal. The orifice member defines an intermediate conduit therethrough. The intermediate conduit is in fluid communication with the base conduit. The orifice assembly includes an orifice cap. The orifice cap defines an upper conduit therethrough. The orifice cap is configured to secure the orifice member to the pedestal. The upper conduit is in fluid communication with the intermediate conduit of the orifice member.

In some embodiments, the base is configured to matingly engage an abrasive body. In some embodiments, the base is a cutting head or an abrasive body. In some embodiments, the base conduit comprises a first cylindrical portion and a second cylindrical portion. In some embodiments, the first cylindrical portion has a different diameter than the second cylindrical portion. In some embodiments, a diameter of the base conduit is larger than a diameter of the intermediate conduit. In some embodiments, the top surface comprises a sealing surface.

In some embodiments, the pedestal is located within a depression in the top surface. In some embodiments, the base conduit comprises a pedestal section and a base section. In some embodiments, the pedestal section has a smaller diameter than the base section. In some embodiments, the upper conduit has a substantially conical shape. In some embodiments, the orifice cap includes a shaped feature configured to contact a circumferential surface of the orifice member. In some embodiments, the shaped feature is oriented to align the base conduit, the intermediate conduit and the upper conduit.

In some embodiments, the orifice cap comprises titanium. In some embodiments, the orifice cap is press fit on the pedestal about the orifice member. In some embodiments, the orifice cap includes a set of circumferential flanges extending radially inward and connecting to a lip disposed about the pedestal. In some embodiments, a parallelism value for the orifice assembly is about 0.00005 to 0.00015 inches. In some embodiments, the planar bottom region of the base and the planar top region of the pedestal are ground to be at least substantially parallel. In some embodiments, the top surface of the base is rounded. In some embodiments, one or more vent features are included in at least one of the pedestal, the orifice cap or the orifice member.

In another aspect, the invention features a liquid jet cutting system. The liquid jet cutting system includes a fluid pump. The liquid jet cutting system includes a cutting head in fluid communication with the fluid pump. The cutting head includes a cutting head body. The cutting head includes an orifice assembly connected to the cutting head body. The orifice assembly defines a portion of a fluid conduit. The orifice assembly includes a base component connected to the cutting head body. The base component includes a protruding orifice engagement region having a top surface. The base component includes a bottom surface parallel to the top surface. The orifice assembly includes an orifice cap disposed about the protruding orifice engagement region. The orifice assembly includes an orifice component disposed between the orifice cap and the orifice engagement region.

In some embodiments, the orifice cap extends substantially about the orifice engagement region. In some embodiments, the orifice component matingly engages the orifice cap. In some embodiments, the orifice cap comprises titanium. In some embodiments, the base component comprises a sealing surface located circumferentially around the orifice engagement region. In some embodiments, one or more vent features are included in at least one of the pedestal, the orifice component or the orifice cap.

In another aspect, the invention features a base component for a liquid jet cutting head. The base component includes a body portion for connecting to a liquid jet cutting head. The body portion at least partially defines a first segment of a liquid jet conduit and a first circumferential surface of the base component. The base component includes an elevated portion extending axially outward from a sealing surface. The elevated portion at least partially defines a second segment of the liquid jet conduit, a platform, and a second circumferential surface. The platform is substantially parallel to a bottom surface of the base component.

In some embodiments, the first and second segments of the liquid jet conduit have different diameters. In some embodiments, the first segment has a larger diameter than the second segment. In some embodiments, the elevated portion is located in or extends from a depression on the sealing surface of the body portion. In some embodiments, the sealing surface is shaped to engage an adapter and create a seal between the sealing surface and the adapter. In some embodiments, the orifice surface of the platform extends above the sealing surface of the body portion. In some embodiments, the first and second circumferential surfaces define a step feature shaped to connect to an orifice cap. In some embodiments, the elevated portion of the base component has an outer diameter configured to be press fit with a cap having an inner diameter. In some embodiments, the outer diameter of the base component is substantially similar to the inner diameter of the cap.

In another aspect, the invention features a method of assembling a waterjet cutting head. The method includes providing an orifice member that defines a first conduit. The method includes disposing the orifice member on a planar surface of a pedestal that protrudes from a surface of a base component. The base component defines a second conduit that is fluidly coupled to the first conduit. The method includes securing the orifice member to the planar surface of the pedestal by fastening an orifice cap to the pedestal. The orifice cap defines a third conduit fluidly coupled to and substantially aligned with the first and second conduits. In some embodiments, the first, second and third conduits are aligned along a central axis of the waterjet cutting head.

In another aspect, the invention features an orifice cap assembly for a liquid jet cutting system. The orifice cap assembly includes a cap. The cap includes a disk-shaped base portion defining a central axis and having a first bore. The cap includes an adjacent distal sleeve portion oriented orthogonally with respect to the base portion. The cap includes a securing member disposed about a circumference of a distal end of the sleeve. The orifice cap assembly includes an orifice member shaped and configured to be secured within the cap. The orifice member defines a second bore.

In some embodiments, the securing member is a continuous flange. In some embodiments, the securing member comprises a plurality of flanges connected to a circumferential region of the base portion. In some embodiments, the plurality of flanges extends axially outward from the base portion. In some embodiments, the cap includes titanium. In some embodiments, the first bore has a substantially conical shape. In some embodiments, the base portion further includes a set of step features shaped to connect to an orifice component.

BRIEF DESCRIPTION OF THE DRAWINGS

The foregoing discussion will be understood more readily from the following detailed description of the invention when taken in conjunction with the accompanying drawings.

DETAILED DESCRIPTION OF THE DRAWINGS

Figure 1:
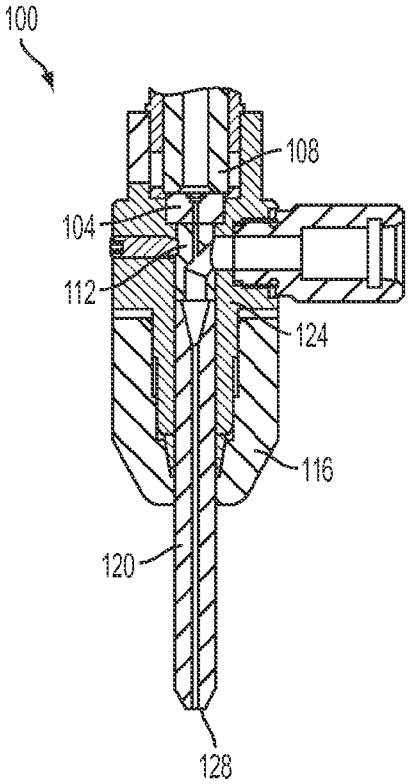
FIG. 1 PRIOR ART
FIG. 1 is a cross-sectional illustration of a prior art waterjet cutting system including an orifice assembly with a standard base component of a waterjet orifice assembly.

FIG. 1 is a cross-sectional illustration of a prior art waterjet cutting head 100 for a waterjet cutting system. The waterjet cutting head 100 includes an orifice assembly 104, an adapter 108, a mixing chamber 112, a nut 116, a nozzle 120, an abrasive body 124, and a nozzle orifice 128. One or more high-pressure cylinders or pump components can be used to generate a high pressure water flow. The high pressure water flow is channeled through the orifice assembly 104 to form a coherent high velocity water stream. The water stream enters the mixing chamber 112, where the water stream may be mixed with abrasive particles (e.g. garnet). The water stream and abrasive particles enter the nozzle 120 and exit through the nozzle orifice 128 to cut a desired material.

Inside the waterjet cutting head 100, the water stream exiting the orifice assembly 104 must be well-aligned to the waterjet nozzle orifice 128. The alignment must be good enough to enable the water stream to pass through the mixing chamber 112 and nozzle 120 without substantially contacting and/or touching the interior wall of the nozzle 120 prior to exiting the cutting head 100. It is preferable for the water stream to be centered within the nozzle 120. Poor water stream alignment will cause the nozzle life and cut performance (e.g. cut speed, part tolerance and edge quality) to deteriorate.

Figure 2:
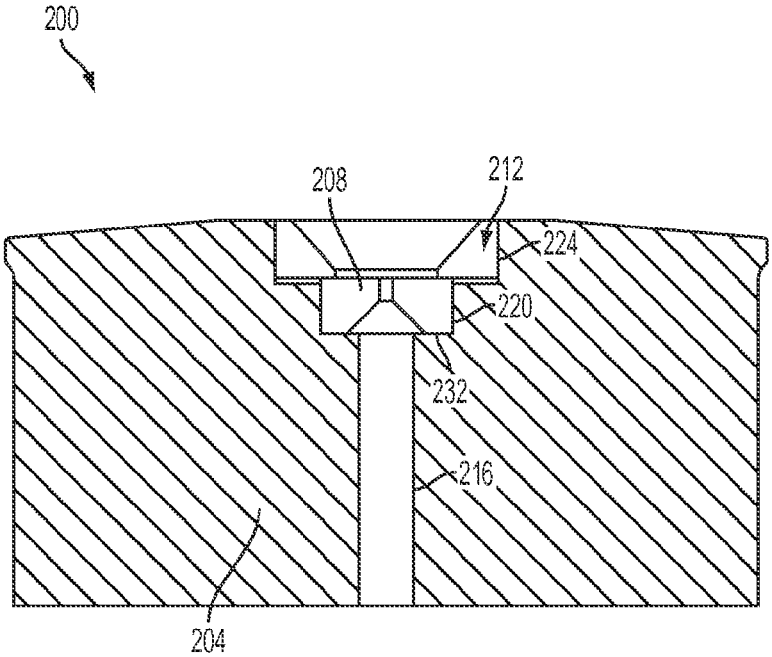
FIG. 2 PRIOR ART
FIG. 2 is a cross-sectional illustration of a prior art waterjet orifice assembly having a standard base component.

FIG. 2 is a cross-sectional illustration of a prior art waterjet orifice assembly 200, e.g. orifice assembly 104 as shown above in FIG. 1. The orifice assembly 200 includes a standard base component 204, an orifice 208, and a press ring 212. The standard base component 204 has a conduit 216 through the center, a smaller counterbore 220 and a larger counterbore 224. The orifice 208 is seated in the smaller counterbore 220. A press ring 212 is inserted into the larger counterbore 224 with a press fit between the outer diameter of the press ring 212 and the inner diameter of the larger counterbore 224. This configuration limits machining access to the orifice seating surface 232 of the base component 204 and creates difficulties in achieving a high degree of machining precision in the region of the smaller counterbore 220 as a result of the limited accessibility. This arrangement requires a small element to reach within smaller counterbore 220 to machine orifice seating surface 232 and the side surfaces of smaller counterbore 220 and larger counterbore 224 for workable pressfits and proper seating of the orifice 208, creating machinability and accuracy issues. Generally, machining a bore in any part requires either a turning or milling operation. For a turning operation, as the tool travels closer to the center of the part, the relative velocity of the tool to the part is much smaller. This variance can affect cut quality to varying degrees, depending on the tool used. To counter this effect, the part can be spun faster, but the faster spinning is limited by the maximum rotational speed of the machine. Similarily, milling or drilling the outer diameter of the bit has a much higher relative speed to the part than the center of the tool. To obtain a perfectly flat surface is nearly impossible and not repeatable. A further challenge is that the bottom seating surface 232 is opposite the base seating surface, which requires the part to be flipped for machining. Holding opposite surfaces parallel to each other to a high degree of accuracy when the part needs to be fixtured more than once introduces opportunity for error and reduces the repeatability of the process.

A number of dimensional tolerances of the cutting head can affect the aligment of the water stream within the cutting head. Testing has shown that a critical factor to good water stream alignment is the degree of parallelism between the top surface of the orifice 208 and the bottom surface of the base component 204. "Parallelism" can be quantified as a linear dimension measuring misalignment between two substantially parallel surfaces, e.g. a difference by which the bottom surface of the orifice 208 is misaligned to a contact surface. Since the orifice 208 can be provided with substantially parallel top and bottom surfaces, the water stream alignment is critically dependent on the ability of the bottom surface of the base component (e.g. base component 204) to be parallel to the orifice seating surface (e.g. orifice seating surface 232).

Figure 3:
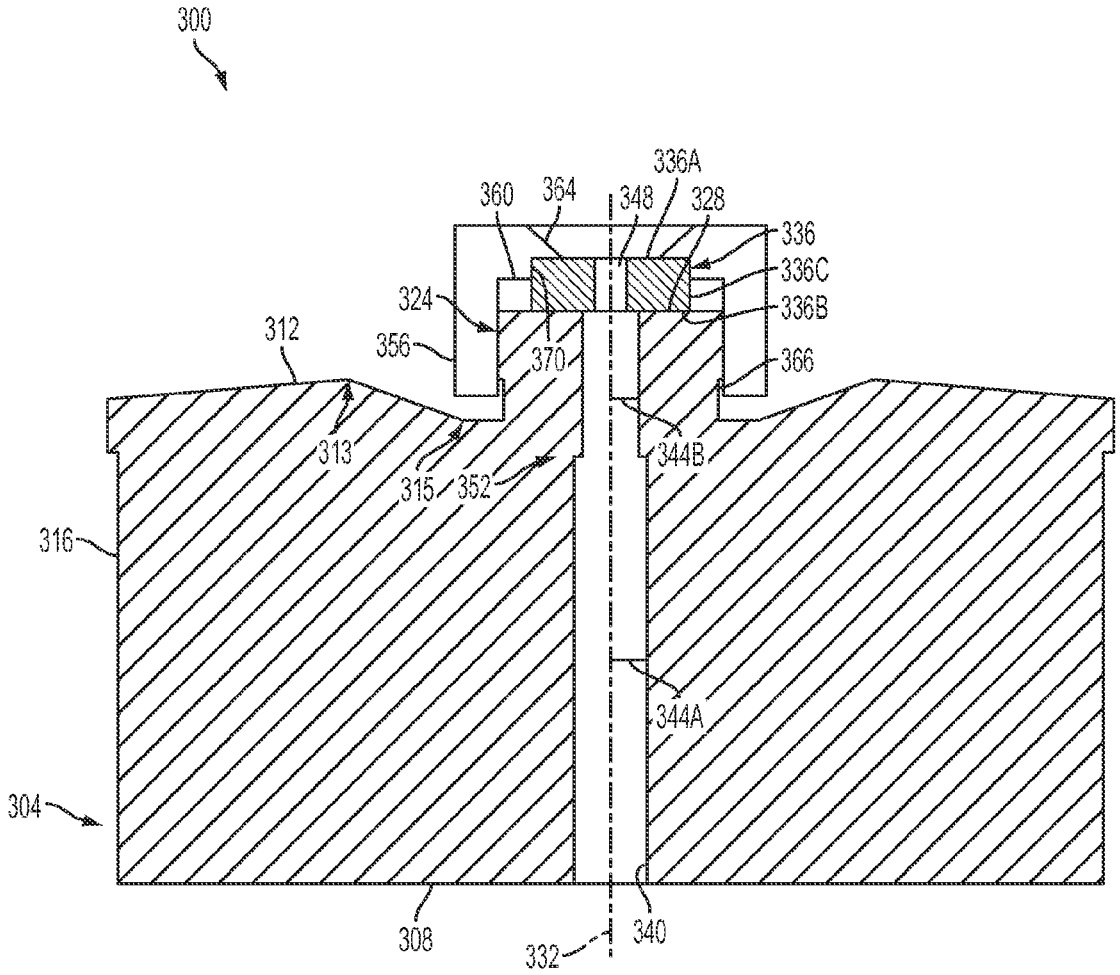
FIG. 3 is a cross-sectional illustration of a waterjet orifice assembly having a pedestal-style base component, according to an illustrative embodiment of the invention.

FIG. 3 is a cross-sectional illustration of a waterjet orifice assembly 300 having a pedestal-style base component 304, according to an illustrative embodiment of the invention. The base component 304 can be generally cylindrical and have a longitudinal center axis 332. The base component 304 can have a base conduit 340, which can be substantially centered along and/or parallel to the center axis 332. The base conduit 340 can include a plurality of diameters, e.g. a first diameter 344A and a second diameter 344B. In some embodiments the first diameter 344A is larger than the second diameter 344B. In some embodiments the plurality of diameters creates one or more step-features, e.g. step feature 352 in the base conduit 340. The step-feature 352 can help support the orifice member 336 by using a smaller diameter below the orifice member 336. Using a larger diameter through a majority of the base component 304 can make the part easier to machine. Without being limited to any single theory, it is believed that when a stream of water is traveling at a high rate of speed it tends to "drag" the adjacent air along with it, creating a localized vacuum. Having a larger diameter bore around the orifice can allow air to move in to displace the air that was pushed out.

The base component 304 has a planar bottom surface 308, a top surface 312, and a side surface 316. The base conduit 340 can extend from the top surface 312 to the planar bottom surface 308. The planar bottom surface 308 can function as the primary datum to the cutting head (not shown) for the orifice assembly 300. The top surface 312 can include a first portion 313 and/or a second portion 315. The first portion 313 can have a convex and/or rounded shape. The first portion 313 can form a high pressure, metal-to-metal water sealing surface when mated with an adapter of the cutting head (not shown). The second portion 315 can form a recess in the top surface (e.g. in an annulus located between the first portion 313 and the protrusion 324). The recess in the top surface can allow space for the press cap while minimizing the overall length of the orifice assembly, and/or can allow for the use of an adequate length press cap while maintaining a short overall profile, thus economizing on the material used.

The top surface 312 can define a protrusion 324, e.g. a pedestal, orifice structure, etc. The protrusion 324 can have a cylindrical or substantially cylindrical shape (or as depicted in FIG. 3, a rectangular or substantially rectangular cross-section). The protrusion 324 can have a planar top surface 328. The planar top surface 328 can be located above the rest of the top surface 312 (e.g. as shown in FIG. 3). When inserted into a cutting head the protrusion 324 can at least partially reside in the cutting head adapter (not shown). In configurations in which the planar top surface 328 protrudes above the rest of the top surface 312, the planar top surface 328 can be ground to be parallel or substantially parallel to the planar bottom surface 308. As described above, this high degree of parallelism can substantially enhance the alignment of the water jet within the cutting head.

The planar top surface 328 of the protrusion 324 contacts (e.g. serves as an orifice seating region for) the orifice member 336. The orifice member 336 can have a substantially cylindrical shape (or as shown in FIG. 3, a substantially rectangular cross-section). The orifice member 336 can be a gem, e.g. diamond or ruby. The orifice member 336 can be composed of natural or synthetic stone. The orifice member 336 has a top surface 336A, a bottom surface 336B, and a side surface 336C. The orifice member 336 has a conduit 348 (e.g. intermediate conduit) through its center. The conduit 348 can be substantially cylindrical and/or substantially centered along the center axis 332 of the base component 304. The conduit 348 can have a diameter smaller than a diameter of the base conduit (e.g. smaller than diameters 344A and/or 344B). The conduit 348 can be in fluid communication with the base conduit 340. The conduit 348 helps to enhance coherency of the water jet as it travels through the orifice member 336. The diameter of the conduit 348 in the orifice member 336 can determine the fluid flow rate at a given pump output pressure. The orifice conduit 348 can convert the potential energy (e.g. pressure upstream) into kinetic energy (e.g. a high velocity stream) which accelerates the abrasive downstream through the nozzle orifice to cut a desired material.

The orifice assembly 300 has a cap 356 (e.g. a press cap). The cap 356 fastens the orifice member 336 to the base component 304. The cap 356 can be press fit onto the base component 304, e.g. onto protrusion 324, an inner diameter of the cap 356 substantially similar to an outer diameter of the protrusion 324. The cap 356 can be made of metal, e.g. Titanium. The cap 356 can have an opening 364 defining an upper conduit in fluid communication with the intermediate conduit 348. The opening 364 can have a substantially conical or frusto-conical shape. When the cap 356 is fastened to the base component 304, empty space or air 360 can exist in between the cap 356, the orifice 336 and the protrusion 324. The protrusion 324 can include a feature 366, e.g. a small cylindrical recess that allows the cap 356 to better grip the protrusion 324. The cap 356 can expand over the protrusion 324 and return to a smaller diameter after passing over the bottom lip of the larger top diameter of the protrusion 324 effectively snapping these components together to prevent the cap 356 from coming off. In some embodiments, the cap 356 includes a shaped feature 370 configured to contact a circumferential surface of the orifice member 336. In some embodiments, the shaped feature 370 can locate the orifice 336 relative to the cap 356 and/or the protrusion 324. In some embodiments, the feature 370 can substantially align the intermediate conduit 348, the opening 364, and the base conduit 340. In some embodiments, the cap 356 includes a set of circumferential flanges extending radially inward and connecting to a lip disposed about the protrusion 324.

In some embodiments, the cap 356 includes a disk-shaped base portion defining a central axis and having a first bore; an adjacent distal sleeve portion oriented orthogonally with respect to the base portion; and a securing member disposed about a circumference of a distal end of the sleeve. In some embodiments, the securing member is a continuous flange. In some embodiments, the securing member comprises a plurality of flanges connected to a circumferential region of the base portion, the plurality of flanges extending axially outward from the base portion. In some embodiments, the base portion includes a set of step features shaped to connect to the orifice component (e.g., protrusion 324).

The base component 304 can be composed of metal, e.g. stainless steel. The base component 304 can have a diameter of about 0.125" to 0.5" or greater, e.g. about 0.436". In some embodiments, the base component 304 is configured to matingly engage an abrasive body. In some embodiments, the base component 304 is a cutting head or an abrasive body. Standalone orifices can be produced to very tight parallelism specifications, such that any deviation is a very small contributor to the overall parallelism of the orifice assembly. The orifice can have a major diameter of about 0.070". The outer diameter of the protrusion 324 (and/or inner diameter of the cap 356) can be about 0.100".

FIGS. 4A-4D are perspective views of a pedestal-style base component of a waterjet orifice assembly, according to illustrative embodiments of the invention (e.g. base component 304 as shown above in reference to FIG. 3). The essential features can be similar to those described above in reference to FIG. 3.

Figure 4A:
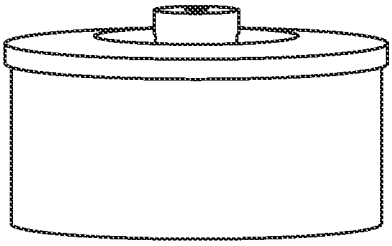
FIGS. 4A-4D are perspective views of a pedestal-style base component of a waterjet orifice assembly, according to illustrative embodiments of the invention.
Figure 4B:
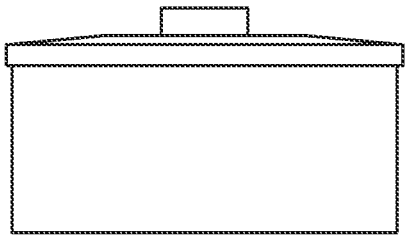
Figure 4C:
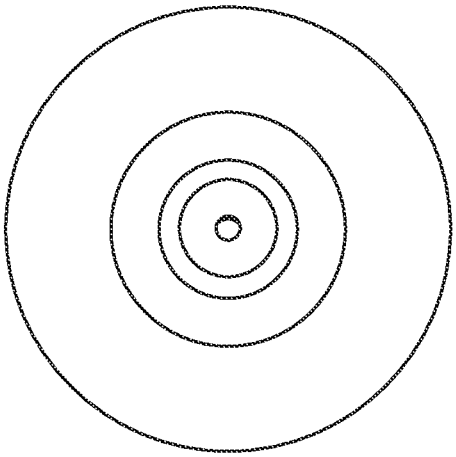
Figure 4D:
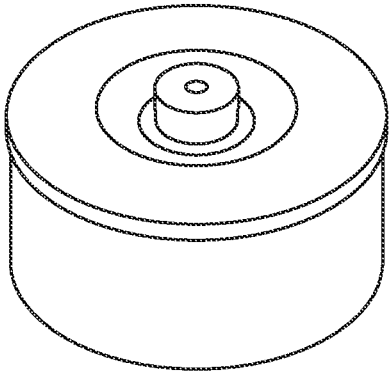
Figure 4E:
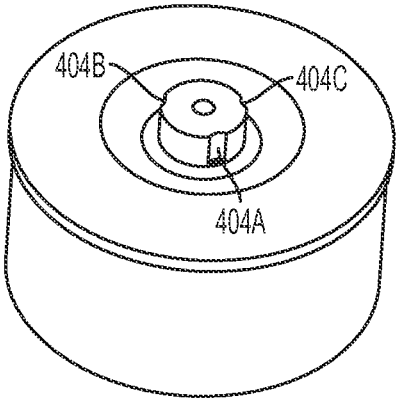
FIG. 4E is a perspective view of a pedestal-style base component of a waterjet orifice assembly having several vent features, according to an illustrative embodiment of the invention.

FIG. 4E is a perspective view of a pedestal-style base component having vent features 404A-404C. During testing, it was found that a pressure differential can be generated between the atmosphere and the region between the orifice and the cap (e.g. empty space or air 360 as shown above in reference to FIG. 3), which can cause cycling which may lead the orifice component to crack sooner than expected. Adding at least one vent feature can provide a means for equalizing the pressure and ensuring that the orifice does not crack prematurely. The vent features 404A-404C can be grooves machined into protrusion 324 (e.g., the pedestal) around the perimeter of the pedestal, e.g. three grooves each separated from the others by 120 degrees. Alternatively or in addition, the vent feature(s) can also be at least one small hole drilled in the press cap component. The vents could also be machined grooves in the press cap press fit surface. Generally, the vent feature(s) can be any feature allowing fluid communication between the surrounding fluid and the region enclosed by the pedestal, the orifice, and/or the press cap, such that the pressure in and around the orifice component can be equalized.

Figure 5:
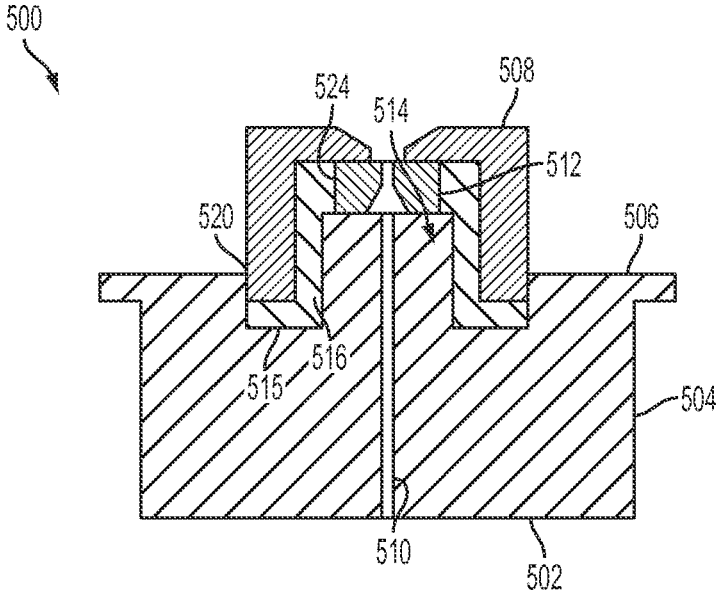
FIG. 5 is a cross-sectional illustration of another waterjet orifice assembly having a pedestal-style base component, according to an illustrative embodiment of the invention.

FIG. 5 is a cross-sectional illustration of another waterjet orifice assembly 500 having a pedestal-style base component 504, according to an illustrative embodiment of the invention. The base component 504 has a planar bottom surface 502, a top surface 506, and a base conduit 510. The top surface 506 has a depression 515 and a protrusion 514. The protrusion 514 can have a planar top surface that acts as a seating region for an orifice 512. A cap 508 can be press fit to retain an orifice 524 on the protrusion 514. This configuration can generally include the same basic components as the orifice assembly 300 described above in reference to FIG. 3. However, in the FIG. 5 configuration, an outer diameter of the cap 508 contacts an inner surface of the depression 515, rather than an inner diameter of the cap 356 contacting an outer diameter of the protrusion 324, as in the embodiment of FIG. 3. Thus, the FIG. 5 configuration can provide an alternate mounting of the pedestal cap 508.

Figure 6:
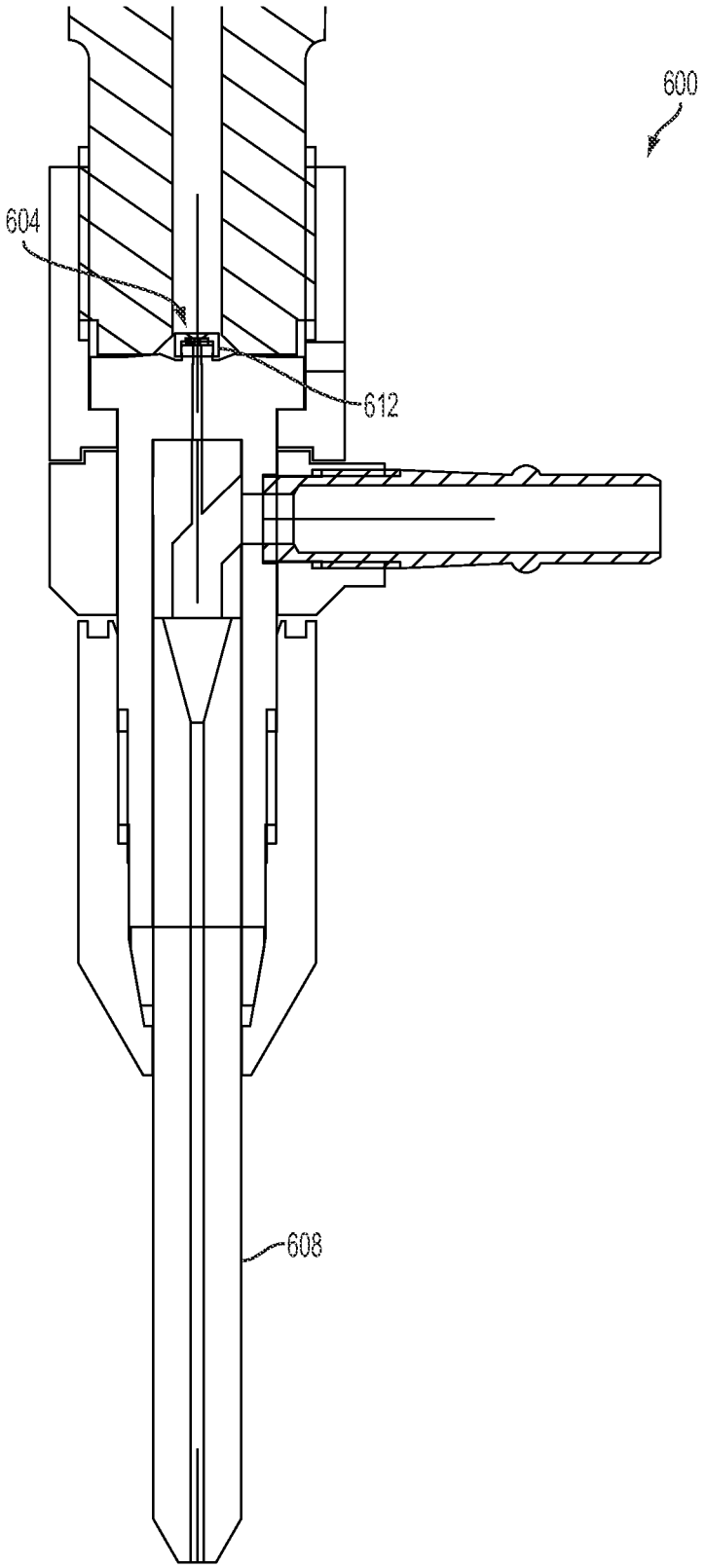
FIG. 6 is a cross-sectional schematic illustration of a waterjet cutting system including a pedestal-style base component of a waterjet orifice assembly, according to an illustrative embodiment of the invention.

FIG. 6 is a cross-sectional schematic illustration of a waterjet cutting system 600 including a pedestal-style base component 604 of a waterjet orifice assembly, a nozzle 608, and a cap 612, according to an illustrative embodiment of the invention. In this configuration, the base component 604 can become the abrasive body of the cutting head. One advantage of this design is that it eliminates a tolerance stackup of other designs between the orifice assembly and the abrasive body, as in this style orifice assembly the orifice mounting surface can be made perpendicular to the axis of the feature that receives the nozzle. Another advantage is that the base becomes the aligning surface for the nozzle, which eliminates several sources of potential misalignment (e.g. orifice assembly to cutting head and/or cutting head to nozzle). This approach also allows for a more compact profile cutting head.

The invention also includes a method of assembling a waterjet cutting head. The method includes providing an orifice member (e.g. the orifice member 336 as shown above in FIG. 3) that defines a first conduit (e.g. the intermediate conduit 348 as shown above in FIG. 3). The method includes disposing the orifice member on a planar surface of a pedestal (e.g. the protrusion 324 as shown above in FIG. 3) that protrudes from a surface of a base component (e.g. the base component 304 as shown above in FIG. 3). The base component defines a second conduit (e.g. the base conduit 340 as shown above in FIG. 3) that is fluidly coupled to the first conduit. The method includes securing the orifice member to the planar surface of the pedestal by fastening an orifice cap (e.g. the orifice cap 356 as shown above in FIG. 3) to the pedestal. The orifice cap defines a third conduit (e.g. the upper conduit 364 as shown above in FIG. 3) fluidly coupled to and substantially aligned with the first and second conduits. In some embodiments, the first, second and third conduits are aligned along a central axis of the waterjet cutting head.

TABLE 1

| Orifice Number | Parallelism (in.) | 0.100" OD |
|---|---|---|
| | GROUND | |
| 1 | 0.0001 | 0.10046 |
| 2 | 0.00007 | 0.10048 |
| 3 | 0.00008 | 0.1004 |
| 4 | 0.00015 | 0.10055 |
| 5 | 0.00005 | 0.10055 |
| 6 | 0.00005 | 0.1065 |
| | AS MACHINED | |
| 1 | 0.00018 | 0.1007 |
| 2 | 0.00049 | 0.10055 |
| 3 | 0.00023 | 0.1005 |
| 4 | 0.00032 | 0.1005 |
| 5 | 0.00018 | 0.10049 |
| 6 | 0.0002 | 0.10048 |

Table 1 shows exemplary data collected using a coordinate measuring machine (CMM) system for several orifice components in accordance with the current invention. In this case, the "parallelism" value represents the distance (measured in inches) at the pedestal's outer diameter of 0.100 inches by which the surface is misaligned relative to the orifice component's bottom surface. In other words, one side of the pedestal's outer diameter is further from the bottom surface of the orifice component than the opposite side of the pedestal's outer diameter by the parallelism value. Comparative data are provided for orifice assembly bases that are both "ground" and "machined." As is evident from Table 1, the parallelism value is much lower (e.g. the surfaces are closer to being parallel) for the ground parts: the average parallelism value for the "ground" orifice components is 0.00008 inches, with a standard deviation of 0.00004 inches; while the average parallelism value for the "machined" orifice components is 0.00027 inches, with a standard deviation of 0.00012 inches.

TABLE 2

| Orifice | Diamond Inner Diameter Measurement micron | In | Test Nozzle | Pump (strokes/min) | Stream Alignment |
|---|---|---|---|---|---|
| AAA .012 | | | .03x3 | 52 | 0 |
| .012 3A | 306 | 0.01205 | .03x3 | 52 | 3 |
| .012 3B | 312 | 0.01228 | .03x3 | 53 | 0 |
| .012 3C | 312 | 0.01228 | .03x3 | 51 | 2 |
| .012 4A | 313 | 0.01232 | .03x3 | 51.5 | 3 |
| .012 4B | 318 | 0.01252 | .03x3 | 51.5 | 3 |
| .012 4C | 313 | 0.01232 | .03x3 | 50 | 3 |
| .012 5A | 308 | 0.01213 | .03x3 | 53 | 3 |
| .012 5B | 322 | 0.01268 | .03x3 | 50 | 3 |
| BBB .013 | | | .03x3 | 59 | −1 |
| .013 6A | 332 | 0.01307 | .03x3 | 56 | 2 |
| .013 6B | 334 | 0.01315 | .03x3 | 58 | 0 |
| .013 6C | 331 | 0.01303 | .03x3 | 56 | 3 |
| .013 7A | 328 | 0.01291 | .03x3 | 56 | 3 |

Table 2 shows stream alignment data that compares benchmark or existing style orifice assemblies to several pedestal style orifice assemblies for diameters of 0.012 inches and 0.013 inches. Eight 0.012 inch diameter pedestal style orifice assemblies and four 0.013 inch diameter pedestal style orifice assemblies were tested for flow rate, stream quality and alignment as compared to the prior art part designs. The numerical values in the "Alignment" column provide a metric for easily quantifying the amount of time for which the stream was aligned, and can be understood as follows: −1 represents no lineup of water in the inlet; 0 represents no lineup of water coming out of the nozzle; 1 represents an alignment of water coming out of the nozzle for 1 second or less; 2 represents an alignment of water coming out of the nozzle for 5 seconds or less; and 3 represents an alignment of water coming out of the nozzle for over 5 seconds. Thus, a higher number is correlated with a longer alignment time and thus a better-aligned assembly. As Table 2 shows, flow rates and stream quality were comparable for all parts, but alignment was significantly better using the ground pedestal.

TABLE 3

| Orifice | | Stream-Quality 55K | Stream Quality 55K | Cohesive Length[1] | Stream Lineup[2] .030 × 3.0 Nozzle | | Stream Lineup[3] .040 × 3.0 Nozzle | | Cycle Test - 55K, 10 |
|---|---|---|---|---|---|---|---|---|---|
| Test #, (Diam.) | Test Nozzle | Water Only Nut | w/Abrasive Nozzle | Water Nut at 55K | Before Cycle | After Cycle | Before Cycle | After Cycle | Cycles/Min, 15 Minutes |
| 1 (0.010") | .030 × 3.0" | Good | Good | 0.5 | | 3 | | | Pass |
| 2 (0.010") | .030 × 3.0" | Good | Good | 0.4 | 2 | 1 | | | Pass |
| 3 (0.010") | .030 × 3.0" | Good | Good | 0.5 | | 2 | | | Pass |
| 4 (0.010") | .030 × 3.0" | Good | Good | 0.7 | | 2 | | | Pass |
| 5 (0.014") | .040 × 3.0" | Good | Good | 0.2 | | 3 | | 3 | Pass |

TABLE 3-continued

| Orifice | | Stream-Quality 55K | Stream Quality 55K | Cohesive Length[1] | Stream Lineup[2] .030 x 3.0 Nozzle | | Stream Lineup[3] .040 x 3.0 Nozzle | | Cycle Test - 55K, 10 |
|---|---|---|---|---|---|---|---|---|---|
| Test #, (Diam.) | Test Nozzle | Water Only Nut | w/Abrasive Nozzle | Water Nut at 55K | Before Cycle | After Cycle | Before Cycle | After Cycle | Cycles/Min, 15 Minutes |
| 6 (0.014") | .040 x 3.0" | Good | Good | 0 | | 3 | | 3 | Pass |
| 7 (0.014") | .040 x 3.0" | Good | Good | 0.3 | | | | 2 | Pass |

[1]The Stream Quality Nut measures the coherent length of the stream from the face of the water-only nut.
[2]The Stream Lineup codes are similar to those show above in Table 2: 0 represents no stream lineup; 1 represents stream alignment for 1 second or less; 2 represents stream alignment for 5 seconds or less; 3 represents stream alignment for over 5 seconds.
[3]Diamonds are existing stock and are used as a benchmark.

Table 3 shows test data comparing parts from existing orifice assemblies and the pedestal style orifice assemblies. Results are included for both 0.010" and 0.014" diameter orifices. The results indicate good stream quality for all orifice assemblies tested. The water-only cohesive length was measured to be slightly longer for the benchmark parts. The stream line-up results were slightly better for the pedestal orifice assemblies than the benchmark parts. The pedestal 0.014" diameter orifice assemblies showed good alignment even to a 0.030" nozzle. All of the parts tested passed the cycle test. During testing, all of the pedestal style orifice assemblies had acceptable alignment test results. These pedestal parts were made without the added expense of an alignment step during manufacturing.

As used herein, it is understood that the term "planar" can also refer to a plane defined by three or more contact points with a contacting surface and/or seat. For example, a ring or raised "rim" can define a plane of a "planar" surface. While the invention has been particularly shown and described with reference to specific preferred embodiments, it should be understood by those skilled in the art that various changes in form and detail may be made therein without departing from the spirit and scope of the invention as defined by the following claims.

What is claimed is:

1. An orifice assembly for a liquid jet cutting system, the orifice assembly comprising:

a base having a bottom surface and a top surface, the base defining a base conduit generally parallel to a central axis of the orifice assembly, the base including a pedestal defining a protrusion from the top surface, the pedestal including a planar top region being at least substantially perpendicular to the base conduit; and an orifice structure disposed on the planar top region of the top surface of the base, the orifice structure defining an intermediate conduit therethrough, the intermediate conduit aligned with and in fluid communication with the base conduit, the intermediate conduit at least substantially perpendicular to the planar top region and parallel to the central axis of the orifice assembly.

2. The orifice assembly of claim 1 wherein the base is configured to matingly engage an abrasive body.

3. The orifice assembly of claim 1 wherein the base is a cutting head or an abrasive body.

4. The orifice assembly of claim 1 wherein the base conduit comprises a first cylindrical portion and a second cylindrical portion, the first cylindrical portion having a different diameter than the second cylindrical portion.

5. The orifice assembly of claim 1 wherein a diameter of the base conduit is larger than a diameter of the intermediate conduit.

6. The orifice assembly of claim 1 wherein the top surface comprises a sealing surface.

7. The orifice assembly of claim 1 wherein a pedestal is located within a depression of the top surface.

8. The orifice assembly of claim 1 wherein the base conduit comprises a first section and a second section, the first section having a smaller diameter than the second section.

9. An orifice assembly for a liquid jet cutting system, the orifice assembly comprising:

a generally cylindrical base having a planar bottom region, a central axis and a top surface, the base defining a base conduit generally parallel to the central axis and extending from the top surface to the planar bottom region of the base, the base including a pedestal defining a protrusion from the top surface of the base, the pedestal having a planar top region substantially parallel to the planar bottom region of the base;

an orifice member on the planar top region of the pedestal, the orifice member defining an intermediate conduit therethrough, the intermediate conduit in fluid communication with the base conduit; and an orifice cap defining an upper conduit therethrough and configured to secure the orifice member to the pedestal, the upper conduit in fluid communication with the intermediate conduit of the orifice member.

10. The orifice assembly of claim 9 wherein the base is configured to matingly engage an abrasive body.

11. The orifice assembly of claim 9 wherein the base is a cutting head or an abrasive body.

12. The orifice assembly of claim 9 wherein the base conduit comprises a first cylindrical portion and a second cylindrical portion, the first cylindrical portion having a different diameter than the second cylindrical portion.

13. The orifice assembly of claim 9 wherein a diameter of the base conduit is larger than a diameter of the intermediate conduit.

14. The orifice assembly of claim 9 wherein the top surface comprises a sealing surface.

15. The orifice assembly of claim 9 wherein the pedestal is located within a depression in the top surface.

16. The orifice assembly of claim 9 wherein the base conduit comprises a pedestal section and a base section, the pedestal section having a smaller diameter than the base section.

17. The orifice assembly of claim 9 wherein the upper conduit has a substantially conical shape.

18. The orifice assembly of claim 9 wherein the orifice cap includes a shaped feature configured to contact a circumferential surface of the orifice member.

19. The orifice assembly of claim 18 wherein the shaped feature is oriented to align the base conduit, the intermediate conduit and the upper conduit.

20. The orifice assembly of claim 9 wherein the orifice cap comprises titanium.

21. The orifice assembly of claim 9 wherein the orifice cap is press fit on the pedestal about the orifice member.

22. The orifice assembly of claim 9 wherein the orifice cap includes a set of circumferential flanges extending radially inward and connecting to a lip disposed about the pedestal.

23. The orifice assembly of claim 9 wherein a linear dimension measuring misalignment between two substantially parallel surfaces of the orifice assembly is about 0.00005 to 0.00015 inches.

24. The orifice assembly of claim 9 wherein the planar bottom region of the base and the planar top region of the pedestal are ground to be at least substantially parallel.

25. The orifice assembly of claim 9 wherein the top surface of the base is rounded.

26. The orifice assembly of claim 9 wherein one or more vent features are included in at least one of the pedestal, the orifice cap or the orifice member.

27. A liquid jet cutting system comprising:

a fluid pump;

a cutting head in fluid communication with the fluid pump, the cutting head including:

a cutting head body; and an orifice assembly connected to the cutting head body and defining a portion of a fluid conduit, the orifice assembly including:

a base component connected to the cutting head body, the base component including (i) a protruding orifice engagement region having a top surface, and (ii) a bottom surface parallel to the top surface;

an orifice cap disposed about the protruding orifice engagement region; and an orifice component disposed between the orifice cap and the orifice engagement region.

28. The liquid jet cutting system of claim 27 wherein the orifice cap extends substantially about the orifice engagement region.

29. The liquid jet cutting system of claim 27 wherein the orifice component matingly engages the orifice cap.

30. The liquid jet cutting system of claim 27 wherein the orifice cap comprises titanium.

31. The liquid jet cutting system of claim 27 wherein the base component comprises a sealing surface located circumferentially around the orifice engagement region.

32. The liquid jet cutting system of claim 27 wherein one or more vent features are included in at least one of the pedestal, the orifice component or the orifice cap.

33. A base component for a liquid jet cutting head, the base component comprising:

a body portion for connecting to a liquid jet cutting head, the body portion at least partially defining a first segment of a liquid jet conduit and a first circumferential surface of the base component; and an elevated portion extending axially outward from a sealing surface, the elevated portion at least partially defining a second segment of the liquid jet conduit, a platform, and a second circumferential surface;

wherein the platform is substantially parallel to a bottom surface of the base component.

34. The base component of claim 33 wherein the first and second segments of the liquid jet conduit have different diameters.

35. The base component of claim 34 wherein the first segment has a larger diameter than the second segment.

36. The base component of claim 33 wherein the elevated portion is located in or extends from a depression on the sealing surface of the body portion.

37. The base component of claim 33 wherein the sealing surface is shaped to engage an adapter and create a seal between the sealing surface and the adapter.

38. The base component of claim 33 wherein the orifice surface of the platform extends above the sealing surface of the body portion.

39. The base component of claim 33 wherein the first and second circumferential surfaces define a step feature shaped to connect to an orifice cap.

40. The base component of claim 33 wherein the elevated portion of the base component has an outer diameter configured to be press fit with a cap having an inner diameter, the outer diameter of the base component substantially similar to the inner diameter of the cap.

41. A method of assembling a waterjet cutting head, the method comprising:

providing an orifice member that defines a first conduit;

disposing the orifice member on a planar surface of a pedestal that protrudes from a surface of a base component, the base component defining a second conduit that is fluidly coupled to the first conduit; and securing the orifice member to the planar surface of the pedestal by fastening an orifice cap to the pedestal, the orifice cap defining a third conduit fluidly coupled to and substantially aligned with the first and second conduits.

42. The method of claim 41 wherein the first, second and third conduits are aligned along a central axis of the waterjet cutting head.

43. An orifice cap assembly for a liquid jet cutting system, the orifice cap assembly comprising:

(i) a cap comprising:

a disk-shaped base portion defining a central axis and having a first bore, the base portion including a set of step features;

an adjacent distal sleeve portion oriented orthogonally with respect to the base portion; and a securing member disposed about a circumference of a distal end of the sleeve, wherein the securing member is a continuous flange or a plurality of flanges connected to a circumferential region of the base portion, the plurality of flanges extending axially outward from the base portion; and (ii) an orifice member shaped and configured to be secured within the cap, the step features shaped to connect to the orifice member, the orifice member defining a second bore.

44. The orifice cap assembly of claim 43 wherein the securing member is a continuous flange.

45. The orifice cap assembly of claim 43 wherein the securing member comprises a plurality of flanges connected to a circumferential region of the base portion, the plurality of flanges extending axially outward from the base portion.

46. The orifice cap assembly of claim 43 wherein the cap includes titanium.

47. The orifice cap assembly of claim 43 wherein the first bore has a substantially conical shape.

48. The orifice cap assembly of claim 43 wherein the base portion further includes a set of step features shaped to connect to an orifice component.

* * * * *